United States Patent [19]

Kageyama

[11] Patent Number: 4,976,561

[45] Date of Patent: Dec. 11, 1990

[54] WRITING TOOLS

[75] Inventor: Shuhei Kageyama, Kawagoeshi, Japan

[73] Assignee: Kotobuki & Co., Ltd., Kyoto, Japan

[21] Appl. No.: 287,616

[22] Filed: Dec. 16, 1988

Related U.S. Application Data

[63] Continuation of Ser. No. 943,477, Dec. 17, 1986, abandoned.

[30] Foreign Application Priority Data

| | | | |
|---|---|---|---|
| Mar. 10, 1986 | [JP] | Japan | 61-153038[U] |
| Mar. 10, 1986 | [JP] | Japan | 61-109562[U] |
| Jul. 16, 1986 | [JP] | Japan | 60-204385[U] |
| Nov. 11, 1986 | [JP] | Japan | 61-182940[U] |

[51] Int. Cl.[5] ..... B43K 21/08

[52] U.S. Cl. ..... 401/75; 401/74; 401/77; 401/78

[58] Field of Search ..... 401/65, 68, 72, 75–78, 401/116, 99

[56] References Cited

U.S. PATENT DOCUMENTS

| | | | |
|---|---|---|---|
| 5,518 | 8/1873 | Downes | 401/77 |
| 612,013 | 10/1898 | Brown | 401/116 |
| 940,247 | 11/1909 | Haring | 401/77 X |
| 1,310,260 | 7/1919 | Troxel | 401/78 |
| 1,702,299 | 2/1929 | Hogner | 401/77 |
| 2,284,162 | 5/1942 | McKnight et al. | 401/78 |
| 2,630,215 | 3/1953 | Lynn | 401/78 |
| 2,827,018 | 3/1958 | Tweeten et al. | 401/75 |
| 3,124,106 | 3/1964 | Kosta | 401/78 |
| 3,672,783 | 6/1972 | Bajusz | 401/116 |
| 3,792,931 | 2/1974 | Ganz | 401/109 |
| 4,136,980 | 1/1979 | Leem | 401/75 X |
| 4,166,707 | 9/1979 | Zawacki et al. | 401/78 X |
| 4,362,410 | 12/1982 | Hashimoto | 401/116 X |
| 4,380,402 | 4/1983 | Andrews et al. | 401/77 X |
| 4,533,272 | 8/1985 | Sakai | 401/116 X |
| 4,573,817 | 5/1986 | Maki et al. | 401/116 X |

FOREIGN PATENT DOCUMENTS

| | | | |
|---|---|---|---|
| 60603 | 1/1892 | Fed. Rep. of Germany | 401/75 |

*Primary Examiner*—V. Millin
*Assistant Examiner*—D. F. Crosby
*Attorney, Agent, or Firm*—Donald D. Mon; David O. O'Reilly

[57] ABSTRACT

A writing tool in which a core casing (3) or (3*a*) is inserted in an outer sleeve (2), and an end (6) of core casing (3) or (3*a*) can be projected out of the end of outer sleeve (2) by operating end (4*a*). End 6 of core casing (3) or (3*a*) can be withdrawn by reverse operation of the operating end (4*a*). A revolution-to-linear movement conversion arrangement for converting a revolutional movement of an operating end (4*a*) to a axial movement between a core casing (3) or (3*a*) and an outer sleeve (2) is provided. A retracting spring (5) between the outer sleeve (2) and the core casing (3) or (3*a*) and the operating end (4*a*) projecting out of a rear end of the outer sleeve (2) can be forcibly operated against the force of a retracting spring (5). The operating end (4*a*) is integral with the rear end of the core casing (3) or (3*a*), with a boss 9 provided on an outside of a rear portion of the core casing (3), (3*a*) or inner sleeve (31), and a helical slit, slot or groove (12*c*) provided at the rear end of the outer sleeve 2, said boss (9) fitting into the helical slit, slot or groove (12*c*). A rear part (41*a*) of the outer sleeve (41) having smaller diameter and a rear sleeve 47 of the same diameter to said outer sleeve 41 is mounted on the rear part (41*a*) for cigarette-like appearance.

2 Claims, 12 Drawing Sheets

WRITING TOOLS

This is a continuation of co-pending application Ser. No. 943,477 filed on Dec. 17, 1986, now abandoned.

Field of the Invention

This invention relates to writing tools including a mechanical pencil and a ball-point pen, particularly to writing tools a tip of which can be projected out of an end of a tube by turning and can be retracted there into by turning reversely.

BACKGROUND OF THE INVENTION

Conventional writing tools uses a double-push arrangement, for example Japanese Patent Publication No. 34-7181, to project the tip out of or retract it into the end of the tube.

FIG. 24 is a longitudinal cross-sectional view of the double-push arrangement and FIGS. 25(*a*) and 25(*b*) are exploded views for illustration thereof.

FIGS. 24, 25(i a) and 25(*b*) show a core casing 3 contained in an outer sleeve 2. The outer sleeve 2 has a cylindrical cam 14 fitted or shaped inside a rear portion thereof. The cylindrical cam 14 has some, say three, axial projecting strips 15 separated at an equal angle inside the rear portion thereof, each projecting strip having a shallow groove shape 16*a* and having a root 17 at an edge thereof.

The conventional writing tools have a push cap 4 provided, which comprises a push cam 18 and a push rod 19. The push cam 18 has six axial strips 20 outside a cylinder portion of the cylindrical cam 14 which are fitted into deep grooves 16*b* formed between the respective shallow groove 16*a* of the cylindrical cam 14 and the respective strips 15 thereof. The strips 20 are made to form a crown which a has peaks 21 and roots 22 on an end of the cylinder portion of the cylindrical cam 14. The push rod 19 projects out of a rear end of the outer sleeve 2.

The core casing has a rotation cam 23 fitted in a rear portion thereof. The rotation cam 23 has on an outside thereof axial strips 24 which can be fitted in the deep grooves 16*b* of the cylindrical cam 14. The strips 24 are made to form a crown which has peaks 25 and roots 26 alternately on an end of the cylindrical portion of the rotation cam 23.

The push rod 19 can be pressed in opposition to a retracting spring (see FIG. 1). The rotation cam 23 and the core casing 3, then, can be pressed in opposition to the retracting spring where slopes of the peaks 25 of the rotation cam 23 are fitted to, but deviate a little from, slopes of the peaks 21 of the push cam 18. The strips 24 of the rotating cam 23, then, can be detached from the deep grooves 16*b* of the cylindrical cam 23 which is in the state shown in FIG. 25(*a*). In this state, the retracting spring presses the slopes of the peaks of the rotation cam 23 to the slopes of peaks 21 of the push cam 18. This can revolve the rotation cam 23 to make the respective peaks and respective roots fit. In turn, the slopes of the peaks of the rotation cam 23 press the slopes of the roots 17 of the cylindrical cam 14 to further revolve the rotation cam 23. The respective peaks 25 of the rotation cam 23, then can fit with the respective roots 17 of the cylindrical cam 14 as shown in FIG. 25(*b*). The end of the core casing 3, thus, can be held projected out of the end of the outer sleeve 2.

In the state shown in FIG. 25(*b*), when the push rod 19 is pressed again in opposition to the retracting spring, the rotation cam 23 and the core casing 3 can be pressed in opposition to the retracting spring where the slopes of the respective peaks 25 are fitted to, but deviate a little, from the slopes of the respective peaks 21 of the push cam 18. This detaches the peaks 25 of the rotation cam 23 from the roots 17 of the cylindrical cam. This allows the rotation cam 23 to turn, which in turn allows the peaks and roots of the rotation cam 23 to fit with the respective peaks and roots of the push cam 18. In turn the force of the retracting spring makes the slopes of the peaks 25 of the rotation cam 23 press the slopes of the respective roots 17 of the cylindrical cam 14 turn the rotation cam 23. The strips 24 of the rotation cam 23, then, can be pressed in the respective deep grooves 16*b* of the cylindrical cam 14 as shown in FIG. 25(*a*). This allows the push rod 19 having the push cam 18 to be retracted. At the same time, the end of the core casing 3 is withdrawn from the end of the outer sleeve 2.

However, the above-described convention writing tools have such serious problems as complicated structure, difficult assembling work, high manufacturing cost and undependability. These difficulties are due to the use of the double-push arrangement comprising the complicated shaped cylindrical cam 14, the push rod 19 having the push cam 18 and the rotation cam 23.

BRIEF DESCRIPTION OF THE INVENTION

In order to resolve the above-mentioned problems, an object of present invention is to provide writing tools that can be easily assembled at lower cost. This object is accomplished to provide writing tools having a revolution-to-linear movement conversion arrangement for converting a revolutional movement of an operating end to an axial movement between a core casing and an outer sleeve.

A second object of this invention is to provide writing tools wherein the core casing is inserted in the outer sleeve, an end of the core casing can be held projected out of an end of the outer sleeve in a way that an operating end projecting out of a rear end of the outer sleeve can be forcibly operated in opposition to a retracting spring, and wherein the end of the core casing can be withdrawn by force of the retracting spring by reverse operation of the operating end. In these writing tools, the operating end can be turned. This revolutional movement is converted to a linear movement by the revolution-to-linear movement arrangement, which is transmitted to the core casing to axially move the core casing. The end of the core casing, thus, can project out of the end of the outer sleeve. When the operating end is reversely turned with the end projected, the core casing can be moved in the opposite direction. This allows the end of the core casing to be withdrawn into the end of the outer sleeve.

A third object of this invention is to provide writing tools having a revolution-to-linear movement conversion arrangement for converting a revolutional movement of an operating end to a axial movement between a core casing and an outer sleeve, wherein the core casing is inserted in the outer sleeve, an end of the core casing can be held projected out of an end of the outer sleeve by handling an operating end projecting out of a rear end of the outer sleeve, and wherein the end of the core casing can be withdrawn by reverse operation of the operating end.

A fourth object of this invention is to provide writing tools having simpler construction wherein the core casing is inserted in the outer sleeve, an end of the core casing can be held projected out of an end of the outer sleeve by handling an operating end projecting out of a rear end of the outer sleeve, and wherein the end of the core casing can be withdrawn by reverse operation of the operating end, the operating end being integral with the rear end of the core casing. A boss is provided on the outside of a rear portion of the core casing of the operating end, a helical slit or groove is provided at the rear end of the outer sleeve, said boss being fitted into the helical slit or groove.

A fifth object of this invention is to provide writing tools wherein a front is slidably mounted in an outer sleeve, a front end of a writing tool member is inserted into and secured to the front, and a rear part of the outer sleeve has a smaller diameter for receiving a rotating sleeve inserted in the rear part rotatably and slidably. A rear end of the writing tool member is inserted into and secured to the rotating sleeve, and a pin is provided on the rotating member. A rear sleeve of the same diameter as said outer sleeve is mounted on the rear part, a helical slot for engaging said pin is provided on an inner face of the rear sleeve or rear part of the outer sleeve and a longitudinal groove is provided on the other inner face of the rear sleeve or rear part.

A sixth object of this invention is to provide writing tools having a cigarette-like appearance.

The above and other objects, advantages and novel features of the invention will be more fully understood from the following detailed description and the accompanying drawings, in which like reference numbers indicate like or similar parts throughout wherein

BRIEF DESCRIPTION OF THE DRAWINGS

FIGS. 13(*b*) and (*c*) are illustrations of essential parts of the revolution-to-linear movement arrangement of a seventh embodiment of according to the present invention.

DETAILED DESCRIPTION OF THE INVENTION

First, construction of the first embodiment of a mechanical pencil according to the present invention is described with reference to FIGS. 1 and 2 as follows.

Figure 1:
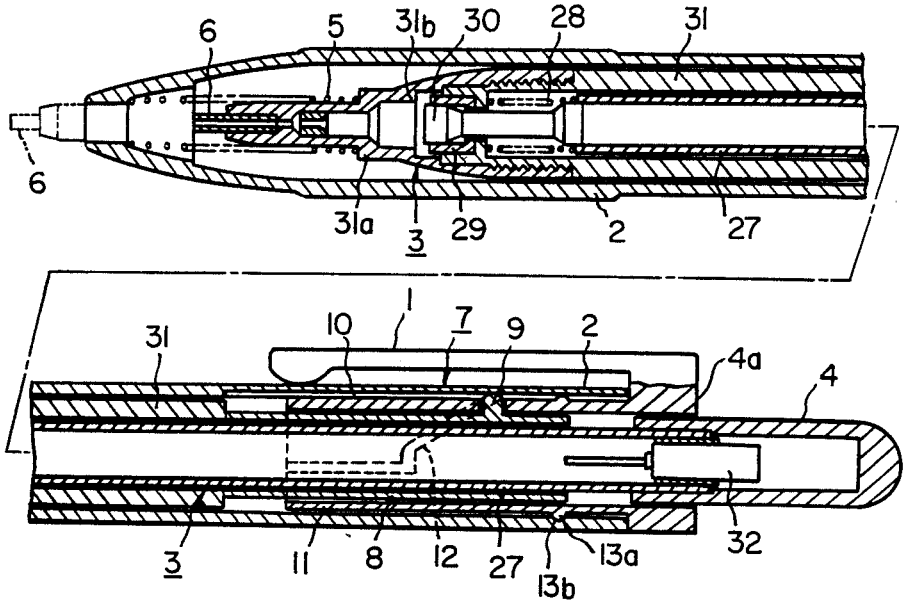
FIG. 1 is a longitudinal cross-sectional view of a first embodiment for writing tools according to the present invention.
Figure 2:
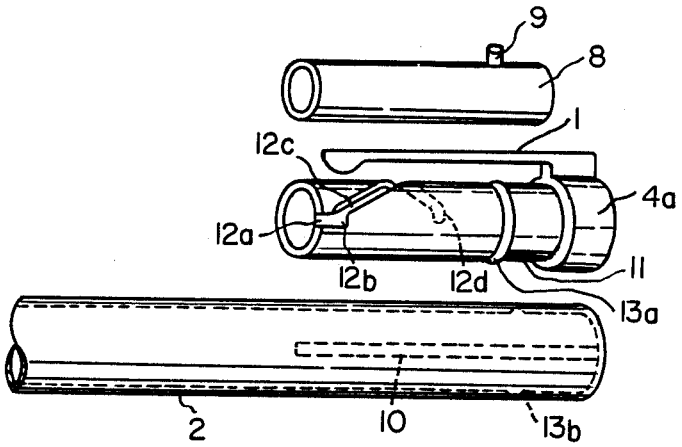
FIG. 2 is a perspective view of the components of a revolution-to-linear movement arrangement for use in the first embodiment.

FIG. 1 shows a core casing 3 that is slidably inserted in an outer sleeve 2 along an axial direction of the outer sleeve 2. The core casing 3 is urged toward the rear direction of the outer sleeve 2 by a retracting spring 5.

The core casing 3 of the mechanical pencil is arranged as follows. The core casing 3 comprises an inner sleeve 31 and a lead container 27 inserted therein. An end portion 31*a* is fitted to the threaded front end of the inner sleeve 31. The lead container 27 in the inner sleeve 31 of the core casing 3 can be moved in an axial backward or forward direction and is biased in a backward direction by the force of a pushing spring 28.

A chuck 30 consisting of three pieces of component parts is fixed at the front end of the lead container 27. A chuck ring 29 is slidably fitted around the chuck 30. When the chuck ring 29 engages at the front end of the chuck 30 as shown in FIG. 1, the chuck 30 clamps the leas. When the chuck 30 is moved forward, with forward movement of the chuck ring 29 prevented by an inner annular edge portion 31*b* of the core casing 3 and moved backward relative to the chuck 30, the chuck 30 releases the lead. This makes the chuck 30 within the inner sleeve 31 close or open by the chuck ring 29 fitted thereon. This allows the lead to be fed to a desired length out of the lead container 27, thereby feeding the lead to the desired length out of an end 6 of the end portion 31*a* of the inner sleeve 31.

FIG. 1 also shows a push cap 4 that fitted on an outside of a rear end of the lead container 27 of the core casing 3 and projecting out of a rear end of the outer sleeve 2. The lead container 27 has an eraser 32 fitted therein.

The core casing 3 and the outer sleeve 2 have a revolution-to-linear movement conversion arrangement 7 provided therebetween, construction of which is as follows.

The revolution-to-linear movement conversion arrangement 7 comprises a linear movement sleeve 8 having a boss 9 provided on an outside of a rear portion thereof. The linear movement sleeve 8 fits over the lead container 27 between the inner sleeve 31 of the core casing 3 and an operating end 4*a*. The outer sleeve 2 has a guide groove 10 extending along axial direction on an inside thereof, in which the end of the boss 9 is engaged to guide the linear movement sleeve 8 in an axial direction.

A revolution sleeve 11 is rotatably fitted at the rear end of the outer sleeve 2. The operating end 4*a* of the rotation sleeve 11 has a clip 1 provided on an outside of the revolution sleeve 11. The revolution sleeve 11 has a ring 13*a* provided on an outside thereof, which fits in annular groove 13*b* provide d on the inside of the outer sleeve 2.

The revolution sleeve 11 has an insertion slit 12*a* opened in an axial direction thereof on a front end thereof, a circular end slit 12*b* connected to the insertion slit 12*a*, a helical slit 12*c* of a half circular length connected to the end slit 12*b*, and has a circular start slit 12*d* connected to the helical slit 12*c*.

The boss 9 on the linear movement sleeve 8 can be inserted into the slits of the revolution sleeve 11 through insertion slits 12*a*, 12*b*, 12*c*, and 12*d*.

The following describes operation of the first embodiment.

The operating end 4*a*, when turned, revolves the revolution sleeve 11, which allows the boss 9 of the linear movement sleeve 8 positioned at the start slit 12*d* to move forward in helical slit 12*c* against the force of the retracting spring 5 (leftward in the figure) within the guide groove 10. This results in linear movement sleeve 8, the core casing 3 and push cap 4 being moved forward and stopped when boss 9 reaches the end slit 12*b*. In this state, the end 6 of the core casing 3 projects out of the end of the outer sleeve 2.

When the push cap 4 is pressed in, the lead container 27 of the core casing 3 can be moved forward or backward in an axial direction against or by the action of the pushing spring 28 This allows the chuck 30 fitted in the chuck ring 29 to open or close, which makes the lead within the lead container 27 feed to a desired length out of the chuck 30. The lead, thus, can be fed to the desired length out of the end 6 of the core casing 3.

To retract the lead into the end 6 of the core casing 3, the push cap 4 can be pressed in opposition to the pushing spring 28. This opens the chuck 30, so that the lead can be withdrawn by pressing on the end of the lead.

To withdraw the end 6 of the core casing 3, the operation end 4*a* is reversely turned, which in turn reversely turns the revolution sleeve 11. This moves the boss 9 of the linear movement sleeve 8 positioned at the end slit 12*b* backward (rightward in the figure) along the guide groove 10 and the helical slit 12*c* by the force of the retracting spring 5. This causes the linear movement sleeve 8, the core casing 3 and push cap 4 to move backward and stop when boss 9 reaches the start slit 12*d*. In this state, the end 6 of the core casing 3 is inside the end of the outer sleeve 2.

Figure 3:
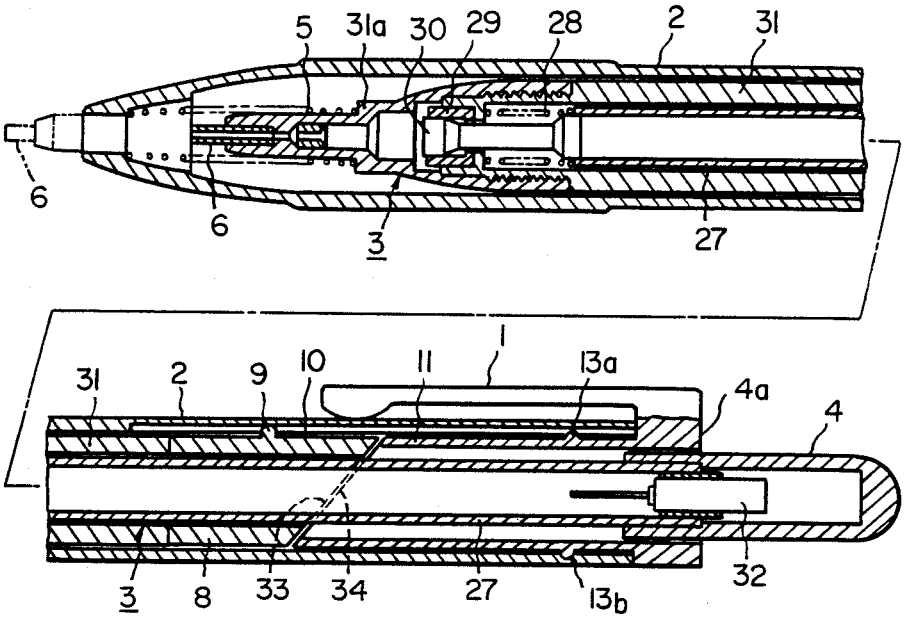
FIG. 3 is a longitudinal cross-sectional view of a second embodiment according to the present invention.
Figure 4:
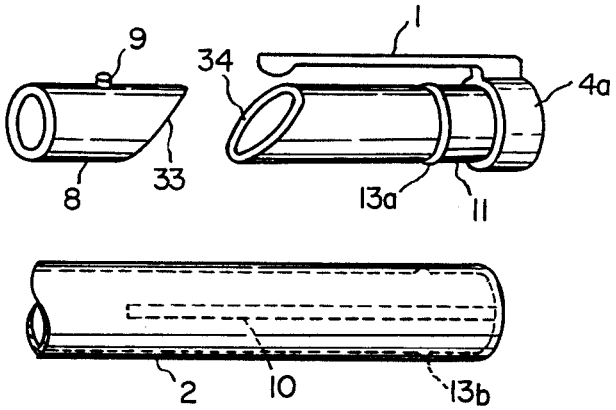
FIG. 4 is a perspective view of components of a revolution-to-linear movement arrangement for use in the second embodiment.

FIGS. 3 and 4 show a second embodiment for mechanical pencil, in which the same numerals are used for the same parts and similar parts. The following describes the revolution-to-linear movement conversion arrangement 7.

In the second embodiment, the linear movement sleeve 8 has a slanted rear end 33. The front end of the revolution sleeve 11 at the operating end 4*a* has a slanted end 34 and facing slanted end 33. The linear movement sleeve 8 is fitted on the lead container 27 of the core casing 3, with its front end being in contact with the inner sleeve 31. THe revolution sleeve 11 has a ring 13*a* that is engaged with the annular groove 13*b* of the outer casing 3 to prevent axial movement, but can revolve with slatned end 33 of the linear movement sleeve 8 facing slanted end 34 of the revolution sleeve 24.

Operation of the second embodiments is as follows. The operating end 4*a*, when turned, turns the revolution sleeve 1. This revolution is converted to a linear forward movement of the linear movement sleeve 8 (leftward in the figure) because the boss 9 of the linear movement sleeve 8 engages guide groove 10 and the slanted end 34 of the revolution sleeve 11 faces slatned end 33. This makes the linear movement sleeve 8, the core casing 3, and push cap 4 move forward by a length determined in terms of the rotation angle of the slanted end 34. In this state, the end 6 of the core casing 3 projects out of the end of the outer sleeve 2.

The end 6 of the core casing 3 can be withdrawn the same way as described for the first embodiment mentioned previously.

Figure 5:
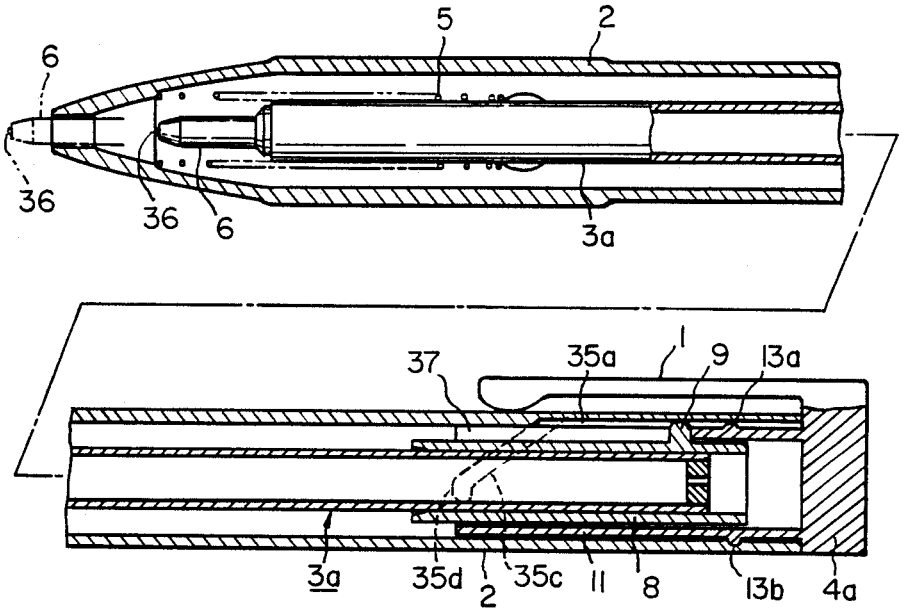
FIG. 5 is a longitudinal cross-sectional view of a third embodiment according to the present invention.
Figure 6:
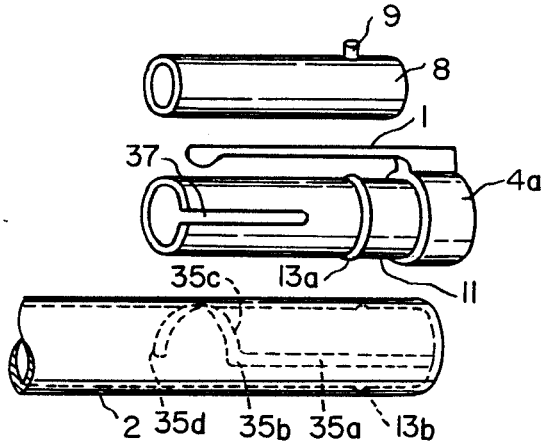
FIG. 6 is a perspective view of components of a revolution-to-linear movement arrangement for use in the third embodiment.

FIGS. 5 and 6 show a third embodiment applied to a ball point pen, in which same numerals are used for same parts and similar parts. The following describes the revolution-to-linear movement conversion arrangement.

The ball point pen of the third embodiment uses a refill-type core casing 3*a*. The core casing 3*a* has a revolving ball held in end 6 thereof and has ink therein.

Construction of the third embodiment is as follows. The third embodiments has an insertion groove 35*a* formed at a rear end of the outer sleeve 2 which extends from a rear edge of of the outer sleeve 2 on an inside of a rear portion thereof, a circular start groove 35*b* connected to the insertion groove 35*a*, a half-circular helical groove 35*c* connected to the start groove 35*b*, and has a circular end groove 35*d* connected to the helical groove 35*c*.

A boss 9 of a linear movement sleeve 8 engages insertion groove 35*a* and the linear movement sleeve 8 is fitted on a rear end of the core casing 3*a* so that the boss 9 can be positioned at the start groove 35*b*.

A revolution sleeve 11 having an operating end 4*a* has an axially extending cut-out guide slit 37 formed at a front portion thereof. The boss 9 is inserted in guide slit 37. The revolution sleeve 11 fits between the outer sleeve 2 and the linear movement sleeve 8 so that the revolution sleeve 11 cannot axially move, but can be turned.

Operation of the third embodiment is described as follows. The operating end 4*a*, when turned, turns the revolution sleeve 11. This causes the boss 9 of the linear movement sleeve 8 positioned at the start groove 35*b* to move forward (leftward in the figure) inside the guide slit 37 along the helical grove 35*c* against the action of a retracting spring 5. This allows the core casing 3*a* to move forward until the boss 9 reaches the end groove 35*d*. In this state, the end 6 of the core casing 3*a* projects out of the end of the outer sleeve 2. The ball point pen then can be used to write.

To draw in the end 6 of the core casing 3*a*, the operating end 4*a* is reversely turned, which in turn reversely rotates the revolution sleeve 11. The boss 9 of the linear movement sleeve 8 positioned at the end groove 35*d* is moved backward (rightward in the figure) inside the guide slit 37 along the helical groove 35*c* by action of the retracting spring 5. This causes the linear movement sleeve e8 and core casing 3*a* to move backward until the boss 9 reaches the start groove 35*b*. In this state, the end 6 of the core casing 3*a* is withdrawn into the end of the outer sleeve 2.

The revolution-to-linear movement conversion arrangement 7 of the mechanical pencil shown in FIGS. 1 and 3 can be replaced with that of the ball point pen shown in FIGS. 5 and 6 and vice versa.

Of course, it should be noted the grooves mentioned in the embodiments can be replaced by slits or slots and the slits can be replaced by grooves or slots.

Figure 7:
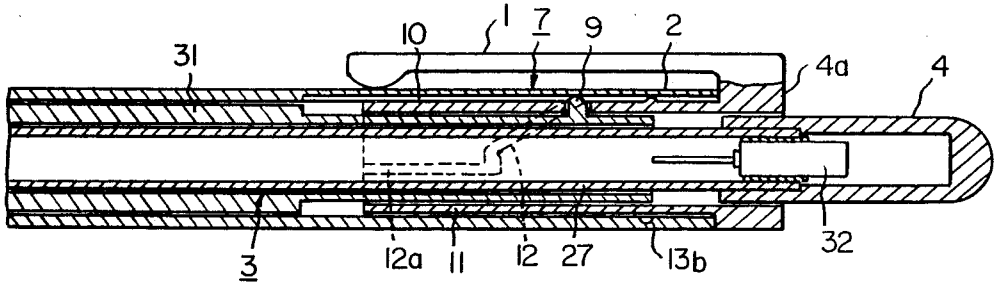
FIG. 7 is a longitudinal cross-sectional view of a fourth embodiment for writing tools according to the present invention.
Figure 8:
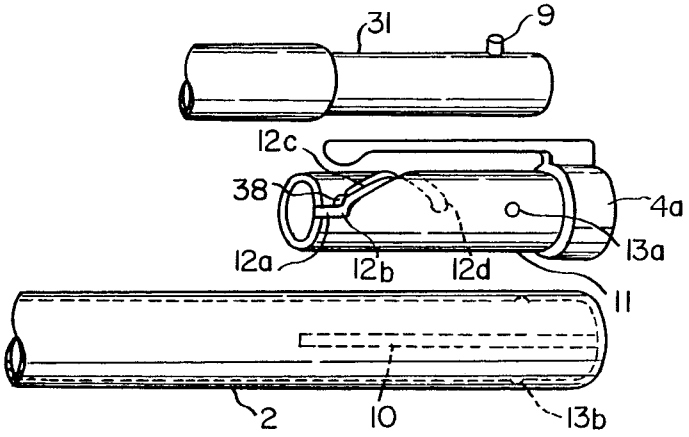
FIG. 8 is a perspective view of components of a revolution-to-linear movement arrangement for use in the fourth embodiment.

FIGS. 7 and 8 show a fourth embodiment according to the present invention applied to an mechanical pencil in which same numerals are used for same parts of the first embodiments. Only different parts are described below.

. The core casing 3 and the outer sleeve 2 have a revolution-to-linear movement conversion arrangement 7 provided therebetween, as in the first embodiment, construction of which is as follows.

In this embodiment, the boss 9 is provided on the inner sleeve 31 instead of on linear movement sleeve 8.

The core casing 3 has a boss 9 provided on an outside of a rear portion of an inner sleeve 31. The outer sleeve 2 has a guide groove 10 provided thereinside which can guide the boss 9 fitted therein to axially move the inner sleeve 31. Insertion slits 12*a*, 12*b*, 12*c* and 12*d* of the revolution sleeve 11 are the same as in the first embodiment. But a convex portion 38 is formed between the insertion slits 12*a* and 12*b*.

The following describes an operation of the fourth embodiment.

The operating end 4*a*, when turned, revolves the revolution sleeve 11, which allows the boss 9 of the inner sleeve 31 positioned at the start slit 12*d* to move along the helical slit 12*c* forward (leftward in the figure) within the guide groove 10. This results in core casing 3 and push cap 4 being mvoed forward and stopped where the boss 9 climbs over the convex portion 38 and reaches the end slit 12*b*. In this state, the end 6 of the core casing 3 projects out of the end of the outer sleeve 2.

When push cap 4 is pressed in, which makes the lead within the lead container 27 feed to a desired length out of the chuck 30, and lead, thus can be fed to the desired length out of the end 6 of the core casing 3 as in the first embodiment.

To retract the lead into the end 6 of the core casing, the push cap 4 is pressed against the pushing spring 28, to open the chuck 30, so that the lead can be withdrawn by pressing on the end of the lead as in the first embodiment.

To withdraw the end 6 of the core casing 3, the operation end 4*a* can be reversely turned, which in turn reversely turns the revolution sleeve 11. This allows the boss 9 of the inner sleeve 31 positioned at the end slit 12*b* to climb over the convex portion 38 and move backward (rightward in the figure) in the guide groove 10 along the helical slit 12*c*. This causes the core casing 3 and push cap 4 to move backward and stop where the boss 9 can reach the start slit 12*d*. In this state, the end 6 of the core casing 3 is inside the end of the outer sleeve 2.

In this embodiment, it should be noted that the retraction spring 5 of the first embodiment can be eliminated.

Figure 9:
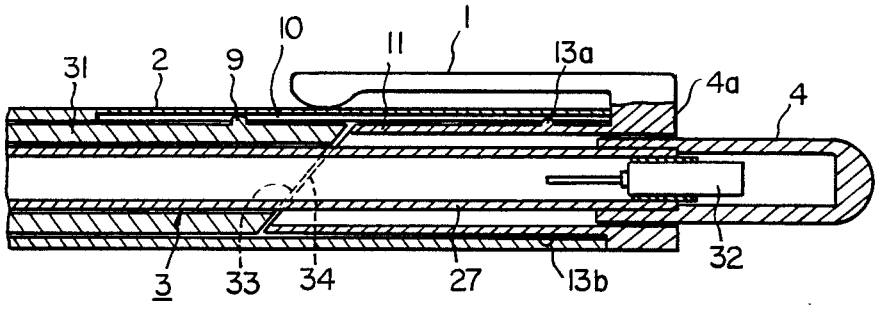
FIG. 9 is a longitudinal cross-sectional view of a fifth embodiment according to the present invention.
Figure 10:
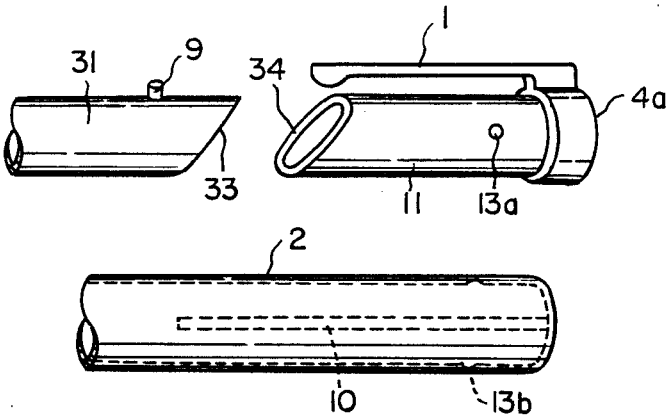
FIG. 10 is a perspective view of components of a revolution-to-linear movement arrangement for use in the fifth embodiment.

FIGS. 9 and 10 show a fifth embodiments for a mechanical pencil. This embodiment is almost the same as the second embodiment.

In the fifth embodiment, the inner sleeve 31 has a slanted end 33 at a rear end thereof. The revolution sleeve 11 of the operating end 4*a* also has a slanted end 34 at a front end thereof facing slanted end 33. THe revolution sleeve 11 is provided with a boss 9 and the end of the boss 9 engages linear guide groove 10 provided in the inner face of the outer sleeve so that the revolution sleeve 11 cannot axially move, but can rotate as the slanted end 33 of the inner sleeve 31 mates with the slanted end 34 of the revolution sleeve 34.

Operation of the fifth embodiment is substantially the same as in the previous embodiments.

Figure 11:
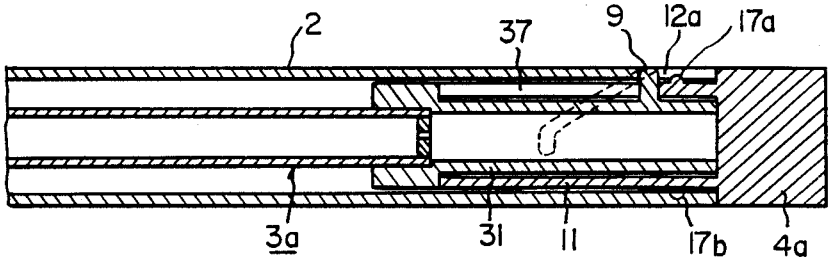
FIG. 11 is a longitudinal cross-sectional view of a sixth embodiment according to the present invention.
Figure 13A:
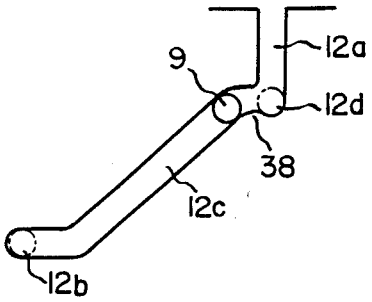
FIGS. 13(*a*) is an illustrations of essential parts of the revolution-to-linear movement arrangement of the sixth embodiment.
Figure 13B:
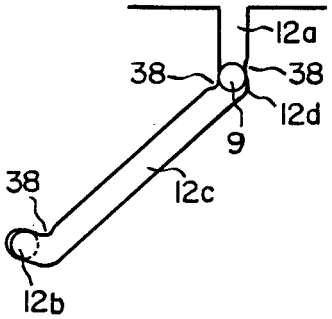
Figure 13C:
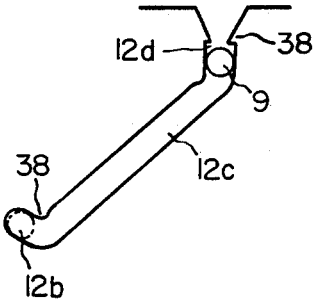
Figure 12:
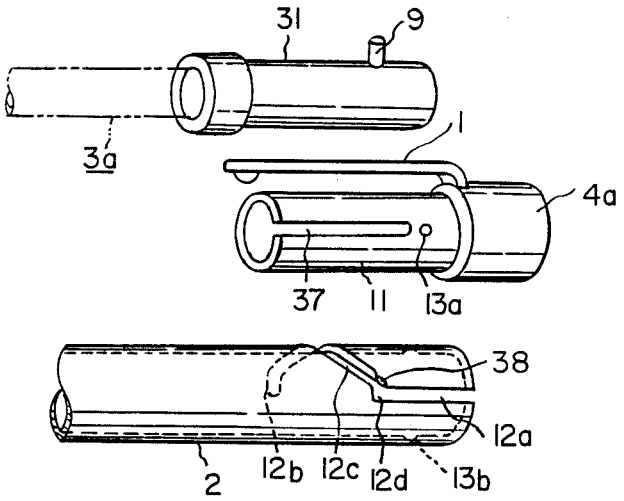
FIG. 12 is a perspective view of components of a revolution-to-linear movement arrangement for use in the sixth embodiment.

FIGS. 11, 12, and 13(*a*) show a sixth embodiments for a ball point pen. embodimentp The ball point pen of the sixth embodimetn uses a refill-type core casing 3*a*. The core casing 3*a* has a revolving ball held in an end 6 thereof and has ink therein.

Construction of the sixth emboidment is substantially the same as the third embodiment except that the boss 9 is provided on the outside of a rear portion of the inner sleeve 31 fitted on a rear portion of the core casing 3*a*. The operating end 4*a* has a guide slit 37 shaped for receiving the boss 9 in from a front edge of the revolution sleeve 11. There are formed an insertion groove 12*a* from a rear edge of an outer sleeve 2 on an inside of a rear portion thereof, a circular start groove 12*d* connected to the insertion groove 12*a*, a convex portion 38 provided between the start slit 12*d* and a helical slit 12*c*, and a half-circular end groove 12*b* connected to the helical groove 12*c*. The revolution sleeve 11 of the operating end 4*a* has a stud 12*a* provided on an outside thereof, and the outer sleeve 2 has a ring groove 13*b* provided to receive the stud 13*a* therein.

The revolution sleeve 11 is fitted on the inner sleeve 31 where the boss 9 of the inner sleeve 31 should be fitted into the guide slit 37 of the revolution sleeve 11. The core casing 3*a* and the revolution sleeve 11 having operating end 4*a* are inserted into the outer sleeve 2 form the rear edge. The boss 9 of the inner sleeve 31 is fitted in the insertion slit 12*a* of the outer sleeve 2. The revolution sleeve 11 is fitted to the rear portion of the outer sleeve 2 with the boss 9 positioned at the start slit 12*c* so that the revolution sleeve 11 cannot axially move as a result of the engagement between the stud 13*a* and the ring groove 13*b*, but can revolve.

The operation of this embodiment is substantially the same as the previous embodiment.

Operation of the sixth embodiment is described as follows. The operating end 4*a*, when turned, turns the revolution sleeve 11. This causes the boss 9 of the inner sleeve 31 positioned at the start slit 12*d* to climb over the convex portion and move forward (leftward in the figure) inside the guide slit 37 along the helical slit 12*c*. This allows the inner sleeve 31 and core casing 3 to move forward until the boss 9 reaches the end slit 12*b*. In this state, the end 6 of the core casing 3*a* projects out of the end of the outer sleeve 2. The ball point pen then can be used to write.

To withdraw end 6 of the core casing 3*a*, the operating end 4*a* is reversely turned, which in turn reversely rotates the revolution sleeve 11. The boss 9 of the linear movement sleeve 8 positioned at the end slit 12*b*, then, is moved backward (rightward in the figure) inside the guide slit 37 by the helical slit 12*c*. This causes the inner sleeve 31 and core casing 3*a* to move backward until the boss 9 runs beyond the convex portion 38 and reaches the start groove 12*d*. In this state, the end 6 of the core casing 3*a* is withdrawn into the end of the outer sleeve 2.

In the present invention, no retracting spring 5 of the core casing 3 is needed but it may be used to assist in the retraction.

In a seventh embodiment according to the present invention as shown in FIGS. 13(*b*) and (*c*), for improving operationability of the operating end, a convex portion 38 may be provided between the end slit 12*b* and the helical slit 12*c*, and may also be provided on the helical slit 12*c* side and the insertion slit 12*a* side of a boundary between the helical slit 12*c* and the insertion slit 12*a*.

These convex portions 38 produce a click sound when the boss 9 from one position to another.

The revolution-to-linear movement conversion arrangement 7 of he mechanical pencil in the fourth and fifth embodiment shown in FIGS. 7 and 10 can be replaced with that of the ball point pen embodiment in the sixth embodiment shown in FIGS. 11 and 12 and vice versa.

It should be noted that the grooves mentioned in the embodiments can be replaced by slits or slots and the slits can be replaced by grooves or slots.

It can be clearly seen from the above description that the fourth to sixth embodiment of this invention provides superior effects such as simple construction, easy assembling, low manufacturing cost and minimum trouble rate as the present invention uses a revolution-to-linear movement arrangement 7 as an arrangement for extending or retracting end 6 of the core casing 3 or 3*a* from the end of the outer sleeve 2. In addition, the present invention is effective in view of the fact that retracting spring 5 can be eliminated.

Figure 14:
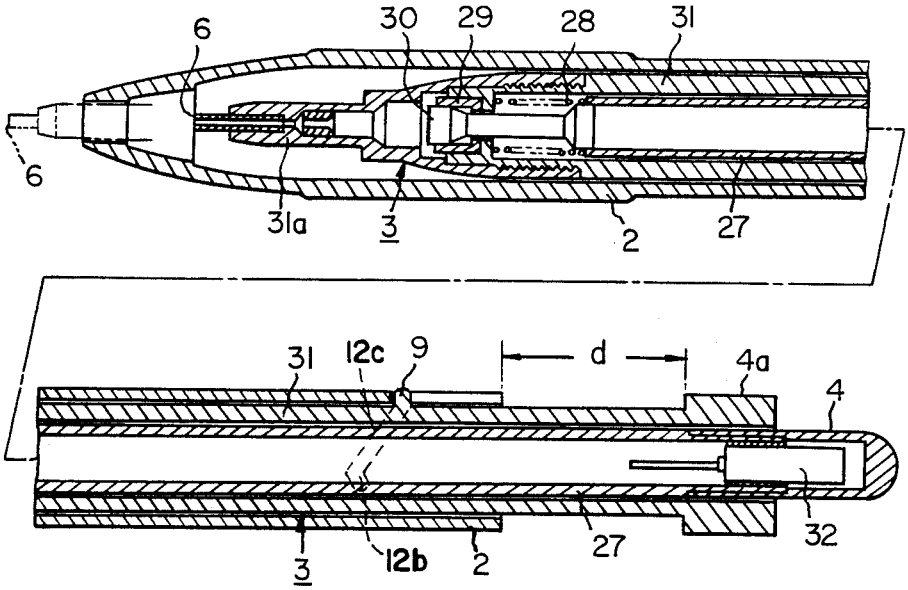
FIG. 14 is a longitudinal cross-sectional veiw of a eighth embodiment according to the present invention.
Figure 15:
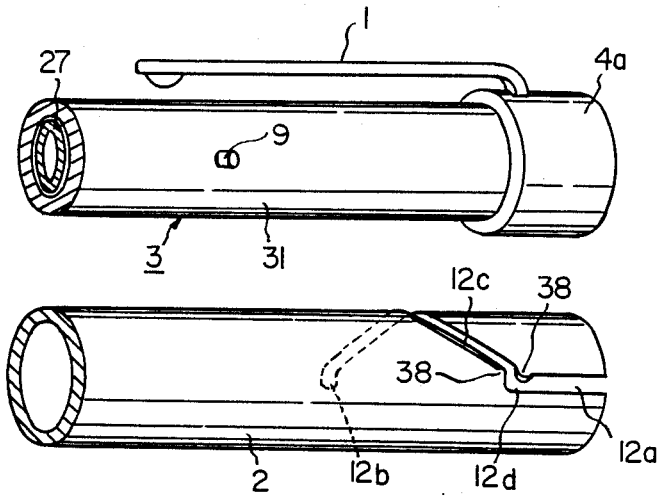
FIG. 15 is a perspective view of components of a revolution-to-linear movement arrangement for use in the eighth embodiment.

FIGS. 14 and 15 show a mechanical pencil as a eighth embodiment of the writing tools according to the present invention.

First, the construction of the eighth embodiment is described below. FIG. 14 shows a core casing 3 that is inserted in an outer sleeve 2. The core casing 3 of this mechanical pencil is the same as previous embodiments.

FIG. 14 also shows a push cap 4 that is fitted on a rear end of the lead container 27 of the core casing 3 and projecting out of a rear end of the outer sleeve 2. The lead container 27 has an eraser 32 fitted therein.

A rear portion of the inner sleeve 31 of the core casing 3 projects out of a rear end of the outer sleeve 2 and is integral with an operating end 4*a* having a clip 1. The rear portion of the inner sleeve 31 has a boss 9 on an outside thereof. The outer sleeve 2 has on a rear portion an axial insertion slit 12*a* formed from the rear end thereof, a circular start groove 12*d* connected to the insertion slit 12*a*, a helical slit 12*c* connected to the start groove 12*d*, a convex portion 38 provided between the start groove 12*d* and the helical slit 12*c*, and a circular slit 12*b* connected to the helical slit 12*c*. The slits 12*a* through 12*a* may be replaced by a groove or slot and the groove 122*d* may be a slit or slot as shown.

The boss 9 provided on the outside of the rear portion of the core casing 3 can be inserted in insertion slit 12*a* of the outer sleeve 2. The boss 9 can climb over the convex portion 38 to be engage start groove 12*d*. There is a clearance d provided between the rear end of the outer sleeve 2 and the operating end 4*a* so that the core casing 3 can axially move to allow the front end 6 to project out of the front end of the outer sleeve 2 when turned. This means that the inner sleeve 31 can project to the length of the clearance d from the rear end of the outer sleeve 2.

The following describes an operation of the eighth embodiment. The operating end 4*a* is turned, the core casing 3 moves forward as turned while boss 9 moves from a position at the start groove 12*d*, over the convex portion 38 and along the helical slit 12*c* to the end slit 12*b*. The front end 6 of the core casing 3, then, projects out of the front end of the outer sleeve 2.

When the push cap 4 is pressed in, the lead container 27 of the core casing 3 can be moved backward or forward is the axial direction against or by the pushing action of spring 28. This allows the chuck 30 fitted in the chuck ring 29 to open or close, which makes the lead within the lead container 27 to feed to a desired length out of the chuck 30. The lead, thus, can be fed to the desired length out of the front end 6 of the core casing.

To retract the lead into the front end 6 of the core casing, the push cap 4 is again pressed in opposition to the pushing spring 28. This can open the chuck 30, so that the lead can be withdrawn by pressing on the end of the lead.

When the front end 6 of the core casing 3 is withdrawn, the operating end 4*a* can be reversely turned. The core casing 3, then, moves backward as turned while the boss 9 thereof starts from the end slit 12*b*, moves along the helical slit 12*c*, climbs over the convex portion 38, and reaches the start groove 12*d*. In this state, the front end 6 of the core casing 3 is inside the front end of the outer sleeve 2.

Figure 16:
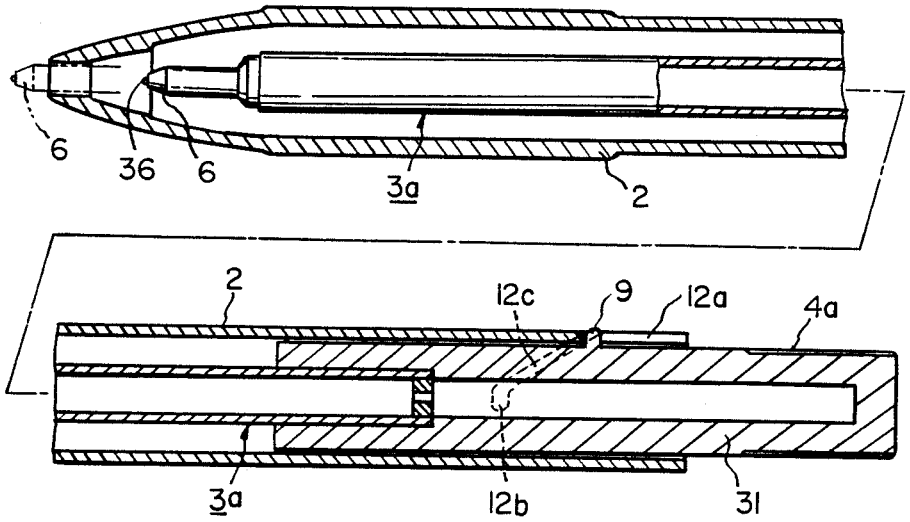
FIG. 16 is a longitudinal cross-sectional view of a ninth embodiment according to the present invention.
Figure 17:
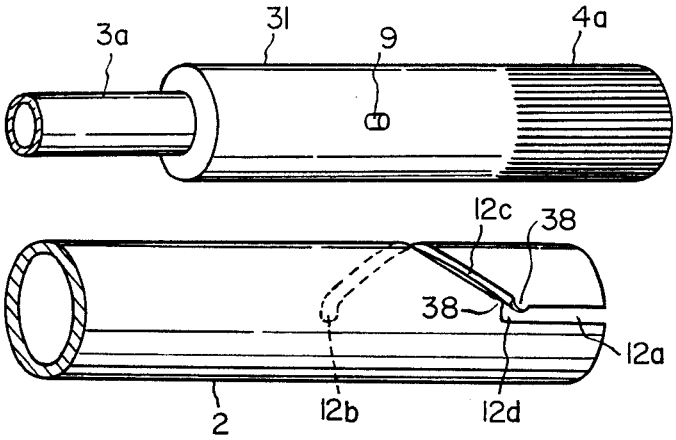
FIG. 17 is a perspective view of components of a revolution -to-linear movement arrangement for use in the ninth embodiment.

In this embodiment, operating end 4*a* is integrally formed on inner sleeve 31 so that the linear movement sleeve 8 is eliminated. Moreover, slits 12*a*, 12*b* and 12*c* and a groove 12*d* are provided in the outer sleeve so that the revolution slit 11 can be eliminated. Therefore, the construction of this embodiment is very simple as compared with the previous embodiment FIGS. 16 and 17 show a ninth embodiment of a ball point pen according to the present invention. The construction of this ninth embodiment is substantially the same as the eighth embodiment.

The ball point pen of the ninth embodiment uses a refill-type core casing 3*a*. The core casing 3*a* has a revolving ball held in an end 6 thereof and has ink therein.

Construction of the ninth embodiment is as follows. The ninth embodiment has a boss 9 on an outside of a rear portion of the inner sleeve 31 fitting over a rear portion of the core casing 3*a*. Slits 12*a*, 12*b* and 12*c* and a groove 12*d* are provided on the outer sleeve 2.

Figure 18:
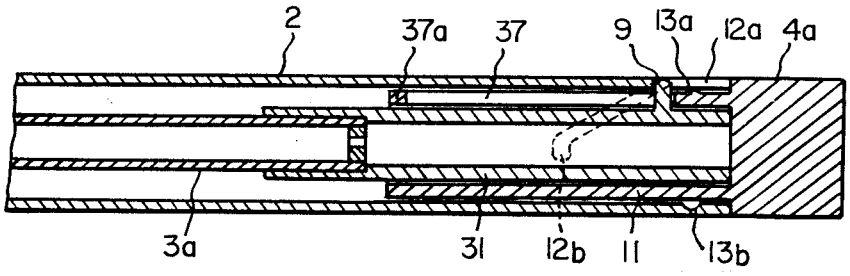
FIG. 18 is a longitudinal cross-sectional view of a tenth embodiment according to the present invention.
Figure 19:
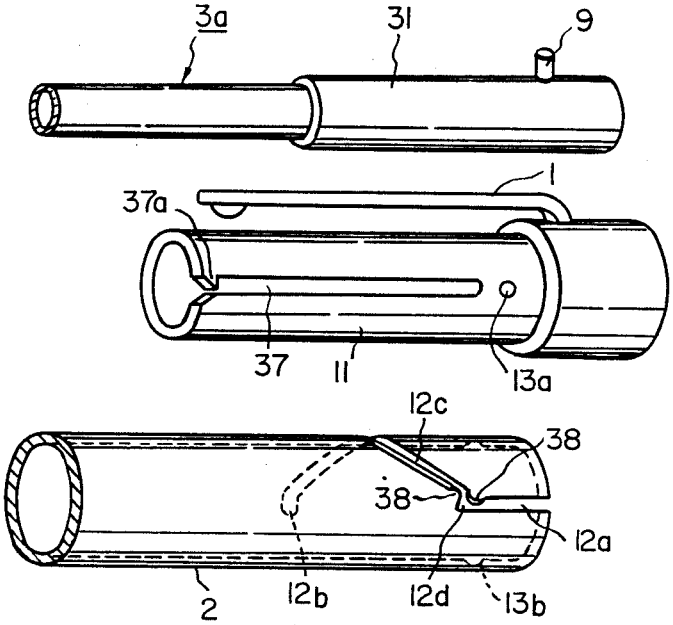
FIG. 19 is a perspective view of components of a revolution-to-linear movement arrangement for use in the tenth embodiment.

FIGS. 18 and 19 show a tenth embodiment according to the present invention of a ball point pen. This tenth embodiment is also substantially the same as the eighth and ninth embodiments, but the revolution sleeve 11 is employed to avoid protrusion of the inner sleeve 31 by a distance of d.

This tenth embodiment has a boss 9 on an outside of a rear portion of the inner sleeve 31 fitting over a rear portion of the core casing 3*a*. The revolution sleeve 11 having an operating end 4*a* has a guide slit 37 extending axially and opens at the rear edge for receiving boss 9 from a rear edge of the revolution sleeve 11. Hindrance projections 37*a* and 37*a* are provided at the open end of the guide slit 37 for folding the boss 9, the inner sleeve 31 and others in the revolution sleeve 11. There are formed an insertion slit 12*a* from a rear edge of an outer sleeve 2 on an inside of a rear portion thereof, a circular start groove 12*d* connected to the insertion slit 12*a* and a half circular helical slit 12*c*, the half circular helical slit 12*c* being connected to the end slit 12*b*. Convex portions 38 and 38 are provided between the start groove 12*d* and the insertion slit 12*a*, and the circular slit 12*c*.

The revolution sleeve 11 of the operating end 4*a* has a stud 13*a* provided on an outside thereof, and the outer sleeve 2 has a ring groove 13*b* provided to receive stud 13*a* therein.

For fitting the revolution sleeve 11 onto the inner sleeve 31, the boss 9 of the inner sleeve 31 of the core casing 3*a* should be inserted into the guide slit 37 of the revolution sleeve 11. Then the core casing 3*a* and the revolution sleeve 11 having the inner sleeve 31 fitted therein are inserted from the rear edge of the outer sleeve 2. The boss 9 of the inner sleeve 31 fits into the outer sleeve 2 from the insertion slit 12*a*. Thus the revolution sleeve 11 is fitted to the rear portion of the outer sleeve 2 with the boss 9 positioned at the start slit 12*c* and the stud 13*a* engaged in ring groove 13*b* so that the revolution sleeve 11 cannot be axially moved, but can revolve.

The operation of this tenth embodiment is substantially the same as the embodiment shown in FIGS. 5 and 6.

Figure 21:
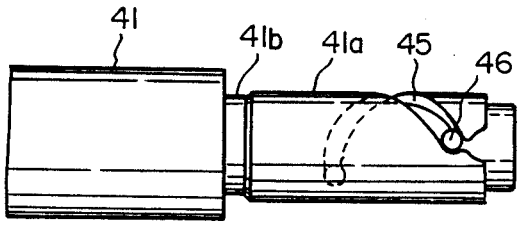
FIG. 21 shows a side view of the rear part of the sleeve of the eleventh embodiment.
Figure 20:
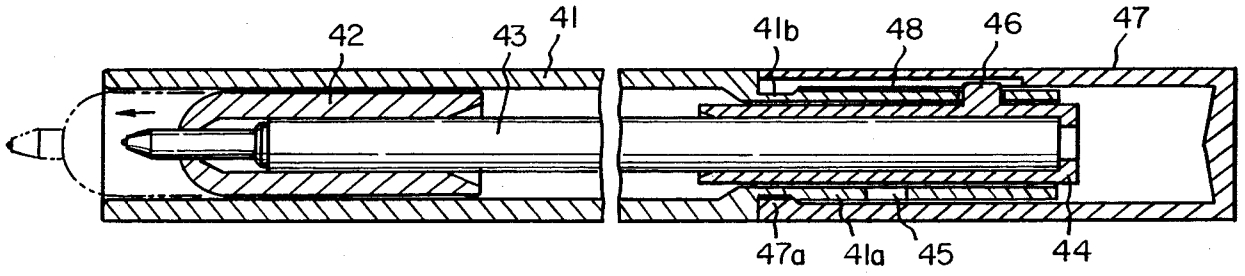
FIG. 20 shows a longitudinal cross section of an eleventh embodiment according to the present invention.

FIGS. 20 and 21 shows an eleventh embodiment according to the present invention. Construction of this embodiment is described below.

An outer sleeve 41 is formed as a small white circular cigarette-type sleeve in which a front tool 42 is slidably mounted. The front end of a writing tool member 43 of a refill ball point pen or a mechanical pencil is inserted into and secured to the center bore of the front tool 42.

The rear part 41*a* of the outer sleeve 41 has a rather smaller diameter, and a rotating sleeve 44 is rotatably and slidably inserted in the rear part 11*a*. A helical slit 45 is provided on the rear part 41*a*, and a pin 46 engages helical slit 45 provided on an outside face of said rotating sleeve 44. A rear sleeve 47 of yellow ocher color like the filter of cigarette is mounted on the rear part 41*a* rotatably. A longitudinal groove 48 is provided in the inner face of the rear sleeve 47 and the end of said pin 46 engages longitudinal groove 48.

An annular recess 41*b* is provided at the base of the outside of the rear part 41*a*, and an annular projection on rear sleeve 47 engages annular recess 41*b* for rotatably holding the rear sleeve 47. Another means may be used for this purpose. The color of the rear sleeve 47 can be different, for example, white.

The operation of the device is as follows.

The operation of the device is as follows.

By the rotation of said rear sleeve 47 in one direction, the rotation sleeve 44 is rotated by the engagement of the pin 46 in longitudinal groove 48 and slides forward in helical slit 45. Then the writing tool member 43 and the front tool 42 slide, forwardly and the front end of the writing tool member 43 projects from the outer sleeve 41 and can be used for writing.

Rotating the rear sleeve 47 in the reverse direction, causes the parts to move reversely and the end of the writing tool member 43 retracts into the outer sleeve 41.

Figure 22:
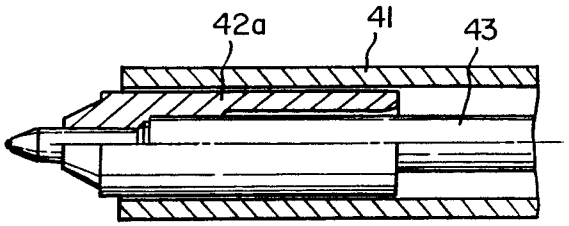
FIG. 22 is a cross section of the front tool of a twelfth embodiment according to the present invention.
Figure 24:
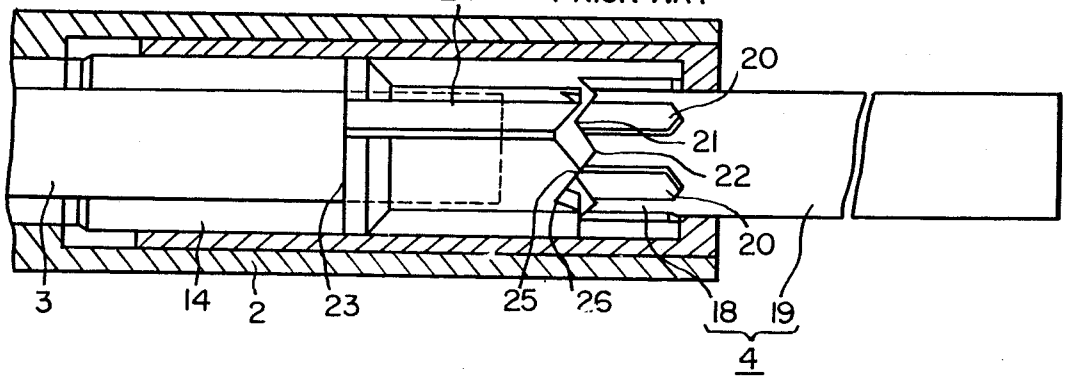
FIG. 24 PRIOR ART
FIG. 24 is a longitudinal cross-sectional view of a double-push arrangement as an example of conventional writing tools.
Figure 25B:
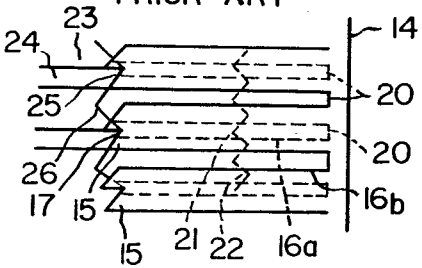
FIG. 25(b) PRIOR ART
FIGS. 25(*a*) and 25(*b*) are exploded illustrations of the double-push arrangement of the conventional writing tools.
Figure 25A:
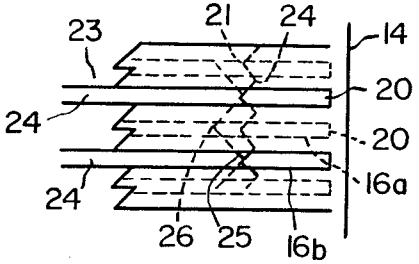
FIG. 25(a) PRIOR ART

As shown in FIGS. 20 and 12, the shape of the front end of the front tool 42 is spherical, but the shape may be conical as in front tool 42*a* in the twelfth embodiment shown in FIG. 22.

Figure 23:
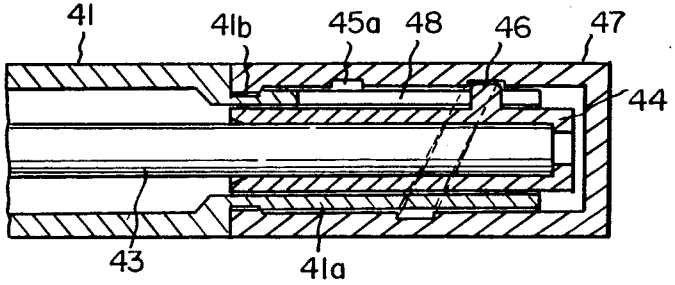
FIG. 23 is a cross section of the rear part of a thirteenth embodiment according to the present invention.

FIG. 23 shows a thirteenth embodiment according to the present invention in which the longitudinal groove 48 is provided on the rear part 41*a* of the outer sleeve 41 and a helical recess 45*a* in which the end of the pin 46 engages is provided at the inside of the rear sleeve 47.

Operation is substantially the same as the embodiment shown in FIGS. 20 and 21.

The shape of a cross section of the outer sleeve 41 may be flat.

As explained above, in these embodiments according to the present invention, interestingly writing tools of cigarette-like appearance can be achieved by coloring the sleeve in white and rear sleeve in yellow ocher for storing in a cigarette casing together with cigarettes. Moreover, the writing tools of these embodiment is simple in the construction and cheap.

What is claimed is:

1. A writing tool comprising an outer casing;

a core casing having writing means at one end; said core casing being insertable in said outer casing;

revolution-to-linear movement means between said outer casing and said core casing;

said revolution-to-linear movement means comprising;

inner sleeve means mounted on the end of said core casing opposite from said writing means end;

a rotatable sleeve fitting over said inner sleeve having a portion abutting said opposite end of said outer casing forming a rotatable operating means;

means between said rotatable sleeve and said inner sleeve means to convert rotational movement of said rotatable operating means to linear movement of said core casing; said cooperating means comprising;

a boss on said inner sleeve on the end opposite said core casing end;

a first linear guiding slit in said rotatably sleeve;

a second guiding slit in said outer casing constructed to cooperate with said guiding slit;

said boss engaging said first and second guiding slits;

said second guiding slit having a linear entrance portion leading to a helical portion terminating in a circular start portion; said second guiding slit including a transitional circular slit portion at the end of said linear entrance portion and a convex restrictive portion at the end of said linear entrance portion, said convex restrictive portion being adjacent said transitional circular portion to provide a resistance to movement of said boss in said second guiding slit;

restrictive means at the entrance to the linear portion of said second guiding slit;

whereby rotational movement of said rotatable operating means in a first direction projects and holds said writing means extending beyond said outer casing, and rotational movement in the opposite direction retracts said writing end, and said rotatable sleeve can be withdrawn from said boss while said inner sleeve is retained.

2. The writing tool according to claim 1 in which said second guiding slit includes a second convex restrictive portion at the transition from said helical portion to said circular start portion. in a

* * * * *